United States Patent [19]

Hughes et al.

[11] 4,327,547

[45] May 4, 1982

[54] FUEL INJECTORS

[75] Inventors: Eric Hughes, Nuneaton; Denis R. Carlisle, Risley; Neville R. Holmes, Exhall, all of England

[73] Assignee: Rolls-Royce Limited, London, England

[21] Appl. No.: 91,574

[22] Filed: Nov. 5, 1979

[30] Foreign Application Priority Data

Nov. 23, 1978 [GB] United Kingdom ..... 45863/78

[51] Int. Cl.[3] ..... F02C 7/22

[52] U.S. Cl. ..... 60/39.46 P; 60/39.55; 60/742

[58] Field of Search ..... 60/39.46 P, 39.55, 733, 60/742, 746

[56] References Cited

U.S. PATENT DOCUMENTS

| | | | |
|---|---|---|---|
| 3,630,024 | 12/1971 | Hopkins | 60/742 |
| 3,691,765 | 9/1972 | Carlisle | 60/742 |
| 3,693,347 | 9/1972 | Kydd | 60/39.55 |
| 3,763,650 | 10/1973 | Hussey et al. | 60/39.46 P |
| 3,777,983 | 12/1973 | Hibbins | 60/742 |
| 3,788,067 | 1/1974 | Carlisle et al. | 60/742 |
| 3,826,080 | 7/1974 | DeCorso et al. | 60/742 |
| 3,866,413 | 2/1975 | Sturgess | 60/742 |

*Primary Examiner*—Louis J. Casaregola

*Attorney, Agent, or Firm*—Cushman, Darby & Cushman

[57] ABSTRACT

A dual fuel injector for a gas turbine engine having means for water injection to reduce NOx emissions, comprises an outer annular gas fuel duct with a venturi section with air purge holes to prevent liquid fuel entering the gas duct, an inner annular liquid fuel duct having inlets for water and liquid fuel and through which compressor air flows, the inner annular duct terminating in a nozzle, and a central flow passage through which compressor air also flows, terminating in a main diffuser having an inner secondary diffuser. The surfaces of both diffusers are arranged so that their surfaces are washed by the compressor air to reduce or prevent the acretion of carbon to the injector, the diffusers in effect forming a hollow pintle.

10 Claims, 5 Drawing Figures

Figure 1:
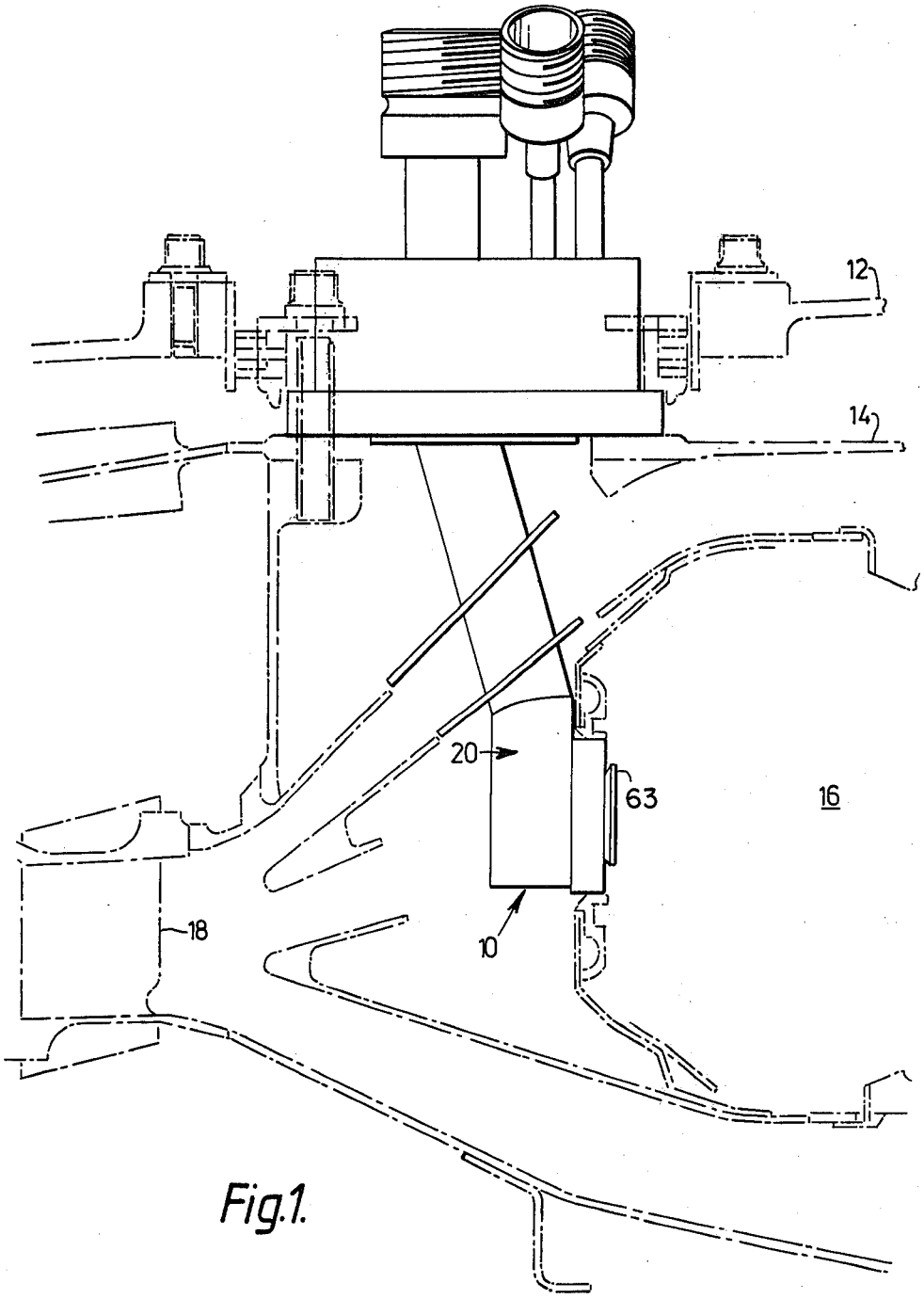

3
28
42
26
24
36
30
20
10
72
38
32
40
34
63
58
54
60
68
56
64
A
62
70
22
58
66
40
34
44
48
46
50
52
3

FUEL INJECTORS

This invention relates to fuel injectors, for example, fuel injectors for gas turbine engines which are capable of running on a liquid fuel, a gaseous fuel or a mixture of liquid and gaseous fuels and in which both the accretion of carbon particles on the injector is minimised and the emission of the oxides of nitrogen is kept to an acceptable level.

The present invention provides a gas turbine engine fuel injector comprising a first body having duct means for a liquid fuel, duct means for a gaseous fuel and duct means for a water supply, a second body located within the first body, a first flow passage for the throughflow of compressed air in communication with the duct means for the liquid fuel and the water supply and having a central second flow path for the through flow of compressed air, having a downstream diffuser portion and flow directing means to direct a flow of air onto at least a part of the diffusing means.

The liquid fuel duct means may comprise a supply duct, a manifold and a plurality of holes drilled tangentially into the manifold, the fuel passing into the first flow passage being swirled thereby and forming a complete sheet of fuel on the wall of the first flow passage.

The gaseous fuel duct means may comprise a gas fuel duct, a partial gas annulus and an exit nozzle. Purge air inlet apertures may be provided in the wall of the first body adjacent the gas exit nozzles, the purge air, supplied from the compressor of the gas turbine engine of which the fuel injector forms apart, preventing liquid fuel from passing into the gas passages.

The water supply duct means may comprise a water supply duct, a manifold and a plurality of radially drilled holes into the manifold, the water supply holes being located upstream of the liquid fuel holes.

The first flow passage may narrow in cross-sectional area towards its downstream end so that a fuel and air mixture or a fuel, air and water mixture in the first flow passage accelerates to a maximum at the exit or nozzle of the first flow passage where it will be sandwiched between air from the air purge holes and air flowing through the second flow path thereby aiding the atomisation of the liquid fuel which had already undergone an atomising process as it passed into the first flow passage.

When water is injected into the first flow passage it also undergoes an atomisation process in a like manner to the liquid fuel.

The diffuser means of the second flow path may comprise a main diffuser and a secondary diffuser located within the main diffuser, the flow directing means conveniently comprising a plurality of flow directing apertures in a wall joining the upstream ends of the main and secondary diffusers, a gap being left between the inner wall of the main diffuser and the downstream end the secondary diffuser so that some of the compressed air flowing through the second flow path will flow through the flow directing apertures, through the said gap and wash over the inner wall of the main diffuser.

Figure 2:
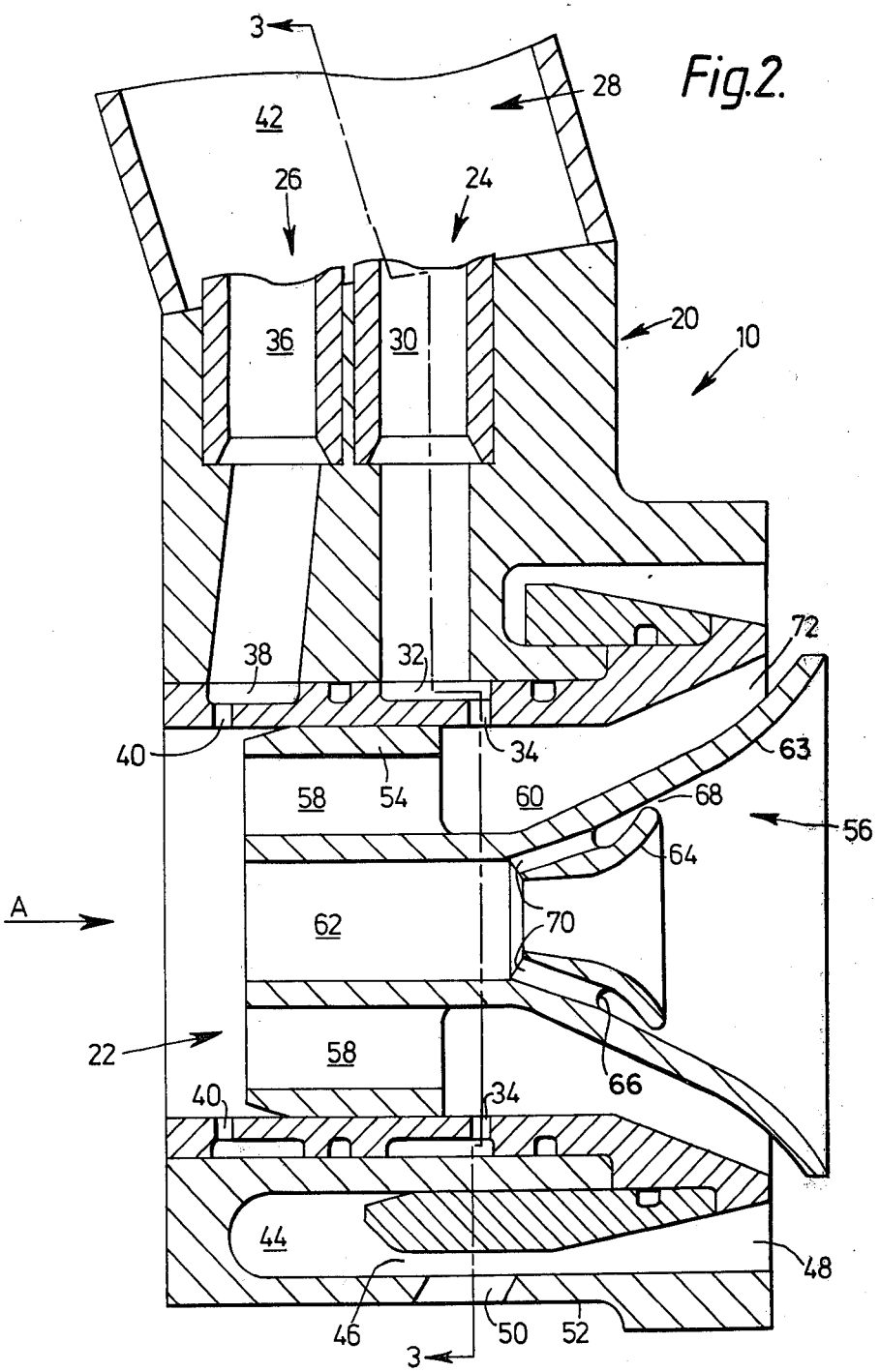
Figure 3:
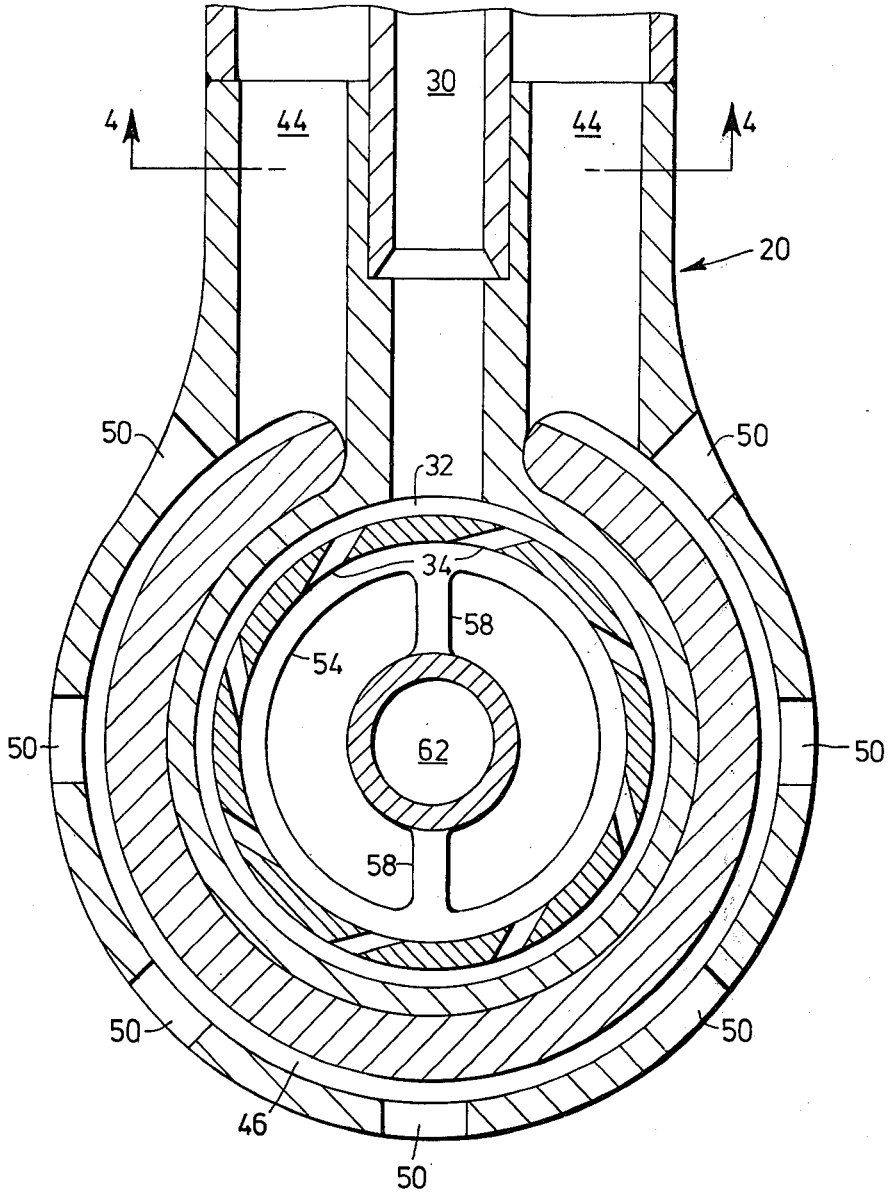
Figure 4:
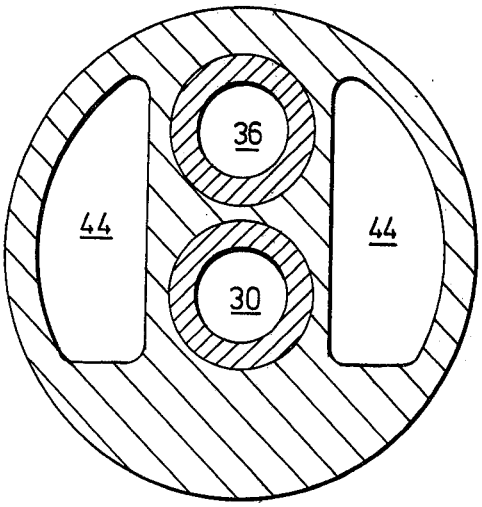
Figure 5:
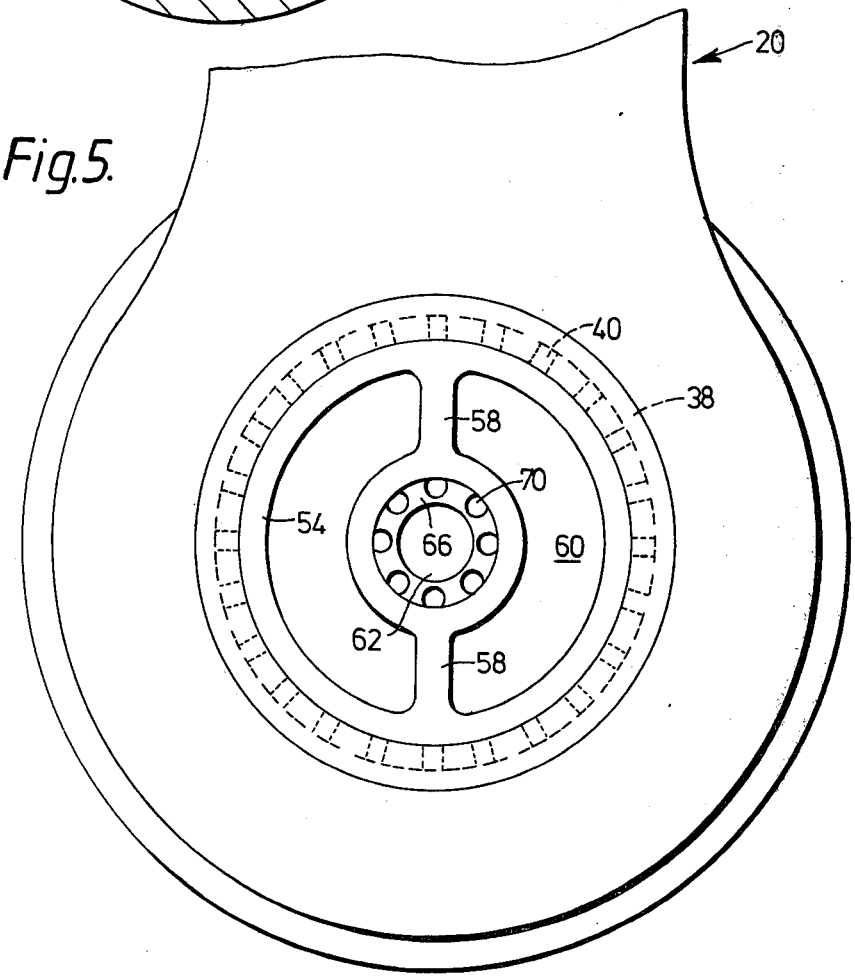

The present invention will now be more particularly described with reference to the accompanying drawings in which, FIG. 1 shows a portion of a gas turbine engine including one form of fuel injector according to the present invention, FIG. 2 shows a detailed sectional view of the fuel injector shown in FIG. 1, FIG. 3 is a section on line 3—3 in FIG. 2, FIG. 4 is a section on line 4—4 in FIG. 3 and, FIG. 5 is a view on arrow A in FIG. 1.

Referring to the Figures, a fuel injector 10 is located in a gas turbine engine only parts of which are shown, namely a casing 12, combustion equipment comprising an outer casing 14 and an annular combustion chamber 16, and a ring of nozzle guide vanes 18 which are located at the exit of a compressor (not shown).

The fuel injector 10 comprises a first body 20 and a second body 22 located within the first body, the first body having liquid fuel duct means 24, water supply duct means 26 and gaseous fuel duct means 28. The duct means 24 comprises a liquid fuel supply duct 30 connected to a fuel manifold which supplies fuel to all the injectors 10 of the engine, a manifold 32 and a plurality of tangentially drilled equi-spaced holes 34 (see FIG. 3). The duct means 26 comprise a water supply duct 36 connected to a water manifold (not shown) which supplies water to all the fuel injectors 10 of the engine, a manifold 38 and a plurality of radially drilled equi-spaced holes 40. The duct means 28 comprises a gaseous fuel duct 42 connected to a gas manifold (not shown) which supplies gaseous fuel to all the fuel injectors 10 of the engine, a part annulus 44 (see FIGS. 3 and 4), a venturi portion 46 and a diffuser portion 48. The first body 20 also has a plurality of radially, as well as forwardly slanting drilled holes 50 through its outer wall 52 in the region of the venturi portion 46, for the inflow of purge air from the engine compressor into the gaseous fuel duct.

The second body 22 comprises an outer ring 54 which is located within the first body between the outlets of the rows of holes 34 and 28, the ring 54 supporting a centreless pintle 56 by two webs 58. A first flow path 60 is defined by the first and second bodies 20, 22 and second flow path 62 is provided through the centre of the second body 22. The centreless pintle 56 comprises a main diffuser 63 and a secondary diffuser 64 which are joined together at their upstream ends by a wall 66, a gap 68 being provided between the inner wall of the main diffuser 63 and the downstream end of the secondary diffuser 64. A plurality of holes 70 drilled in the wall 66 provide a flow directing means for air flowing through the second flow path 62.

In operation, liquid fuel flows through the duct 30 into the manifold 32 and through the tangential holes 34 into the first flow path 60, a complete sheet of fuel being formed on the outer wall of the flow path 60, the air from the compressor which flows through the first flow path shears the fuel from the holes 34 causing atomisation and the fuel and air mixture accelerates along the flow path as the flow decreases in cross-section to a minimum at its exit 72.

The liquid fuel and air mixture of fluid which passes from the exit 72 of the first flow path or passage 60 fuel injector 10 is also subject to a partial shear effect since the outflowing mixture will be sandwiched between an outer layer of air flowing from the purge holes 50 out of the diffuser 48 and an inner layer of air which has flowed through the second flow passage or path 62, the shear effect aiding the atomisation of fuel and water.

When a gaseous fuel is being burnt, the gaseous fuel passes from the gas manifold into the gas duct 42, the part annulus 44, the venturi portion 46, where purge air enters through the holes 50 and then from the diffuser 48. As the gaseous fuel leaves the diffuser 48 of the injector it is met by relatively high velocity air flowing out of the exit 72 of the first flow path or passage 60 which directs the gaseous fuel into the combustion chamber 16.

The purge holes 50 are provided to prevent liquid fuel from entering the gas fuel duct when the engine is running on liquid fuel, which would otherwise cause explosion and fires on changeover from liquid to gas fuel. The purge air fills the gas duct 44 and because the shape of the passage of the duct or annulus 44 at its discharge end, it defines the natural diffuser 48, the air clings to the walls of the passage preventing entry to any liquid fuel. Additionally, the air flowing through the purge holes tends to break up the gaseous fuel flow into discrete jets and makes the gaseous flow more stable. Thus the gaseous flow is more like that from a conventional gas burner in which the gas is discharged from a nozzle through individual jets.

Nitrogen oxides (NOx) produced by the combustion of fuels in gas turbine engines are formed by the combination of nitrogen and oxygen in the combustion air, and from the combination of nitrogen in the fuel with oxygen from the combustion air. There are four basic methods of reducing NOx: (i) by reducing the combustion pressure (ii) by decreasing the peak flame temperature (iii) by reducing the effective residence time during which the combustion gases remain at elevated temperatures and (iv) by controlling the amounts of nitrogen and oxygen available for the production of NOx. The present invention approaches the problem of NOx suppression by water injection, the water being introduced via the fuel injector.

The method requires water to be injected into the combustion process to provide a heat sink, which absorbs some of the heat produced by the combustion of fuel and air, thereby reducing peak combustion temperatures and the rate of NOx formation. The degree of NOx reduction depends upon the rate and method of introducing water, the best results being obtained by direct injection of atomised water into the primary zone of the combustion chamber.

In the present arrangement this is achieved by water fed from a manifold through the duct 36, into the manifold 38. The water is then introduced to the compressor air in the flow path 60 using the cross stream injection principle through the holes 40 where the water is atomised, this method having the advantage of a uniform circumferential pattern and a minimum length requirement. The internal shape of the flow path 60 is such that the majority of the water is atomised through the exit 72 of the injector to be mixed directly with the fuel in the primary zone of the combustion chamber. Only high purity water must be used for this method in order to minimise corrosion of engine components. NOx emissions can be reduced by between 70–90% using a 1:1 water/fuel ratio, although there may be a reduction of up to 1.0% in gas turbine efficiency.

The centreless pintle 56 has been specifically designed to cope with the problem of carbon accretion on the fuel injector. In all combustion operations in gas turbine engines a certain amount of carbon is produced in the process, and some of the carbon will build up on certain areas of the injector. When the carbon builds up to a certain height it breaks away from the injector and travels through the combustion chamber to the turbine, where it can cause erosion of the turbine blade leading edges, or even a total blade failure.

The present design has attempted to alleviate this problem by initially reducing as far as is possible, the surface area available to which the carbon can adhere and where this solution was not possible to wash those surfaces to which carbon could adhere, with air from the engine compressor.

In the centreless pintle 56, compressor air flows along the flow path 62 and washes the inner surface of the secondary diffuser 64 and at least some of the inner wall of the main diffuser 63 by natural diffusion. The remaining compressor air flows through the ring of holes 70 and then through the annular gap 68 so that the entire inner wall of the main diffuser 63 can be washed with compressor air. By this means, carbon accretion on the fuel injector may be reduced to an acceptable level, at which although some carbon may adhere, it will break off in relatively small pieces which would not damage downstream engine components.

We claim:

1. A gas turbine fuel injector comprising:

a first body including liquid fuel duct means and gaseous fuel duct means;

a hollow second body positioned within said first body, said first and second bodies defining therebetween a first annular flow passage for throughflow of compressed air, said first annular flow passage being in communication with said liquid fuel duct means, and said first annular flow passage terminating in a downstream end portion for accelerating flow of fluid therein and therefrom;

said hollow second body defining a central second flow passage for the throughflow of only compressed air, said hollow second body having a downstream end defining a main diffuser; and flow directing means in said second flow passage of said hollow second body for directing flow of compressed air onto the interior surface of said main diffuser to wash the same and decrease carbon buildup thereon.

2. A fuel injector as claimed in claim 1 in which said liquid fuel duct means includes a manifold in said first body and a plurality of holes formed tangentially of and communicating with said manifold, said plurality of holes opening tangentially into said first annular flow passage.

3. A fuel injector as claimed in claim 1 in which said downstream end portion of said first annular flow passage decreases in cross-sectional area to a minimum cross-sectional area at the extremity thereof whereby flow of fluid in the first flow passage accelerates.

4. A fuel injector as claimed in claim 1 in which said gaseous fuel duct means includes an annular duct positioned in said first body and surrounding said first annular flow passage, a portion of said annular duct being of reduced cross-sectional area, and including purge air inlet apertures in said first body opening to said portion of reduced cross-sectional area of said annular duct.

5. A fuel injector as claimed in claim 1 in which said flow directing means in said second flow passage includes a secondary diffuser positioned internally of said main diffuser.

6. A fuel injector as claimed in claim 5 in which said flow directing means further includes a radially extending wall between said main and secondary diffusers, said wall having a plurality of flow directing apertures therethrough and an annular gap between the downstream end of said secondary diffuser and the inner wall of said main diffuser for directing flow of compressed air onto the inner wall of said main diffuser.

7. A gas turbine engine fuel injector as claimed in any one of claims 1 through 6 including a water supply means in said first body communicating with said first annular flow passage.

8. A fuel injector as claimed in claim 7 in which said water supply means includes an annular manifold in said first body and a plurality of holes communicating with said manifold and with said first flow path, said water supply holes being positioned upstream of the communication of said liquid fuel duct means with said first flow path.

9. A gas turbine engine fuel injector comprising:

a central flow passage terminating at its downstream end in a main diffuser, said central flow passage being only for throughflow of compressed air;

an outer annular flow passage surrounding said central flow passage for throughflow of compressed air and/or liquid fuel, said outer annular flow passage having a downstream end portion terminating in an annular nozzle, said downstream end portion defining a venturi for accelerating the throughflow of fluid through the outer annular flow passage and annular nozzle;

a further annular flow passage surrounding said outer annular flow passage, said further annular flow passage being for throughflow of gaseous fuel and including a portion of reduced cross-sectional area;

purge air inlets communicating with said portion of reduced cross-sectional area of said further annular flow passage; and flow directing means in said central flow passage for directing compressed air over the interior of said main diffuser to wash the same and reduce carbon buildup thereon.

10. A fuel injector as claimed in claim 9 in which said flow directing means comprises a secondary diffuser located within said main diffuser, said main diffuser and said secondary diffuser being joined together at their upstream ends by a wall, said wall having a plurality of apertures therethrough, a gap between the downstream end of said secondary diffuser and said main diffuser, compressed air flowing through said central flow passage being directed through said secondary diffuser over the inner wall of said main diffuser and through said apertures and gap over the inner wall of said main diffuser.

* * * * *